US011057726B2

(12) United States Patent
Gouin

(10) Patent No.: US 11,057,726 B2
(45) Date of Patent: Jul. 6, 2021

(54) METHOD AND SYSTEM FOR CONFIGURING AN ALARM SYSTEM

(71) Applicant: JOHNSON CONTROLS FIRE PROTECTION LP, Boca Raton, FL (US)

(72) Inventor: Alexandre Gouin, Saint-Basile-le-Grand (CA)

(73) Assignee: SENSORMATIC ELECTRONICS, LLC, Boca Raton, FL (US)

( * ) Notice: Subject to any disclaimer, the term of this patent is extended or adjusted under 35 U.S.C. 154(b) by 0 days.

(21) Appl. No.: 16/698,334

(22) Filed: Nov. 27, 2019

(65) Prior Publication Data

US 2021/0160637 A1 May 27, 2021

(51) Int. Cl.

| | |
|---|---|
| ***H04R 29/00*** | (2006.01) |
| ***G08B 17/00*** | (2006.01) |
| ***G10L 21/0232*** | (2013.01) |
| ***G10L 25/51*** | (2013.01) |

(52) U.S. Cl.

CPC ..... *H04R 29/001* (2013.01); *G08B 17/00* (2013.01); *G10L 21/0232* (2013.01); *G10L 25/51* (2013.01); *H04R 2430/01* (2013.01)

(58) Field of Classification Search

None

See application file for complete search history.

(56) References Cited

U.S. PATENT DOCUMENTS

| | | | | |
|---|---|---|---|---|
| 2008/0219458 | A1* | 9/2008 | Brooks | G08B 29/126 381/57 |
| 2012/0121096 | A1* | 5/2012 | Chen | G10L 21/0364 381/57 |
| 2016/0247364 | A1* | 8/2016 | Herman | G06F 3/165 |

* cited by examiner

*Primary Examiner* — James K Mooney

(74) *Attorney, Agent, or Firm* — Arent Fox, LLP

(57) ABSTRACT

A computer device for configuring an alarm system comprises at least one sound measuring device and a processor configured to receive from the sound measuring device an ambient noise level at a plurality of measuring locations in a building, determine for each of the plurality of the measuring locations, a target alert sound level of an alert generated by at least one of a plurality of alerting devices based at least in part on the ambient noise level at the respective measuring location, receive an actual sound output value of the alert at each of the plurality of measuring locations from one or more of the plurality of alerting devices, and adjust a sound output of each of the plurality of alerting devices by an adjustment value based on the actual sound output values and the target alert sound levels.

23 Claims, 4 Drawing Sheets

METHOD AND SYSTEM FOR CONFIGURING AN ALARM SYSTEM

TECHNICAL FIELD

The disclosure relates generally to the field of alarm systems, and more particularly to a system and a method for configuring an alarm system.

BACKGROUND

One of the issues with alarm systems relates to setting up the level of sound of the alarm devices.

Existing systems may configure sound alerting devices based on standard ambient noise levels in different areas of a building based on a table that provides such ambient sound level standards for different types of buildings or different areas. The sound alerting devices are then installed with these ambient sound level standard settings, and manual spot checks are conducted, e.g., walking through the building while the system is in alarm mode to record the sound pressure. Subsequently, each sound alerting device may have its sound level manually adjusted if the initial measurement does not comply with industry standards. Then, the manual testing and adjustment procedures may be repeated, as necessary, until the industry standard is achieved. Such measuring of sound pressures is time consuming, cost intensive (additional hardware and labor), hazardous to hearing ability of the person taking measurements, and prone to errors in calibration of the alarm systems.

Additionally, with existing systems, hot (more than desired sound pressure) and cold (less than desired sound pressure) spots of sound pressures may exist in the building due to non-uniform distribution of sound pressures across the building.

SUMMARY

In view of the forgoing, a system and method are disclosed for configuring an alarm system.

The system and method may allow a processor of a sound measuring device to receive an ambient noise level at a plurality of measuring locations in a building. The system and method may determine for each of the plurality of the measuring locations, a target alert sound level of an alert generated by at least one of a plurality of alerting devices based at least in part on the ambient noise level at the respective measuring location. The system and method may receive an actual sound output value of the alert at each of the plurality of measuring locations from one or more of the plurality of alerting devices. The system and method may further adjust a sound output of each of the plurality of alerting devices by an adjustment value based on the actual sound output values and the target sound output values.

The system and method may activate the alert at the one or more of the plurality of alerting devices to generate the respective actual sound output values of the alert.

The system and method may determine whether the respective actual sound output values meet the respective target alert sound levels. The system and method may further adjust the sound output of each of the plurality of alerting devices by the adjustment value based on a difference between the actual sound output values and the target alert sound levels.

In adjusting the sound output of each of the plurality of alerting devices by the adjustment value, the system and method may further determine the adjustment value to be between a minimum sound threshold and a maximum sound threshold.

The system and method may further measure the ambient noise level at a plurality of measuring locations and the actual sound output values at the measuring locations.

The system and method may include a microphone as the sound measuring device.

The system and method may receive the ambient noise level at the plurality of measuring locations in the building via a wired communication link or via a wireless communication link.

The system and method may utilize a fire alarm as the alerting device.

The system and method may comprise a first set of alerting devices located in a same location as a first set of measuring devices and at least one of the first set of alerting devices located in a different location from a second set of measuring devices, wherein the second set of measuring devices are configured to detect sound from the first set of alerting devices.

The system and method may receive the ambient noise level further as a plurality of ambient noise level measurements. The system and method may filter out spike noise level measurements lasting up to a pre-determined duration of time from the plurality of ambient noise level measurements to define a filtered plurality of noise level measurements, determine a peak ambient noise level from the filtered plurality of noise level measurements, determine an average ambient noise level from the ambient noise level measurements, and adjust the sound output of each of the plurality of alerting devices based on at least one of the peak ambient noise level and the average ambient noise level.

The system and method may further receive the actual sound output value from the plurality of alerting devices operating simultaneously.

The system and method may further determine the target alert sound level based on reading values from a table comprising a listing of standards and one or more ambient noise level thresholds corresponding to each of the listing of standards.

BRIEF DESCRIPTION OF THE DRAWINGS

By way of example, specific embodiments of the disclosed system (computer device) and the method will now be described, with reference to the accompanying drawings, in which.

DETAILED DESCRIPTION

As discussed above, various flaws exist in existing systems for configuring alarm systems. To this end, a system (computer device) and a method for configuring an alarm system in accordance with the present disclosure will now be described more fully hereinafter with reference to the accompanying drawings. In some examples, the system and method may be used to configure an alarm system for the first time (for example, when the alarm system is being installed and alerting devices are placed at selected locations). In other examples, the system or method may be used to configure the alarm system at a later time, for example during service of the alarm system or upgrading the alarm system.

In some embodiments, the system and method may dynamically adjust the sound output of one or more alerting devices to provide a target alert sound level. In some embodiments, the system and method may measure the actual sound output value of the alerting devices and adjust the sound output of each of the plurality of alerting devices to achieve a target alert sound level between a minimum sound threshold and a maximum sound threshold.

The system may quickly be updated if there are changes in the building (e.g., different partitions, addition of a door(s), furniture movements, installation of new machines, etc.). The system may allow automated and dynamic volume adjustments for the installation of alerting devices based on ambient sound level measurements at multiple-points.

Thus, the system can measure the actual ambient noise levels and use these actual ambient noise measurements, along with actual (and, in some cases, real-time) sound output measurements, to easily and dynamically configure the sound alerting devices in an alarm system with the target alert sound level, which may reduce labor, hardware costs, and prevent hearing hazards to the user(s) testing the system.

It will be appreciated that the system and method for configuring the alarm system may be implemented for virtually any type of sound based alerting systems, for example sirens, audio tones, automated (pre-recorded) announcements, manual (voice) announcements, etc. The system and method may be utilized for different kinds of buildings (e.g., auditoriums, hospitals, office spaces, etc.). The system and method may also be used for one or more open areas or in combination of open areas and closed buildings.

Figure 1:
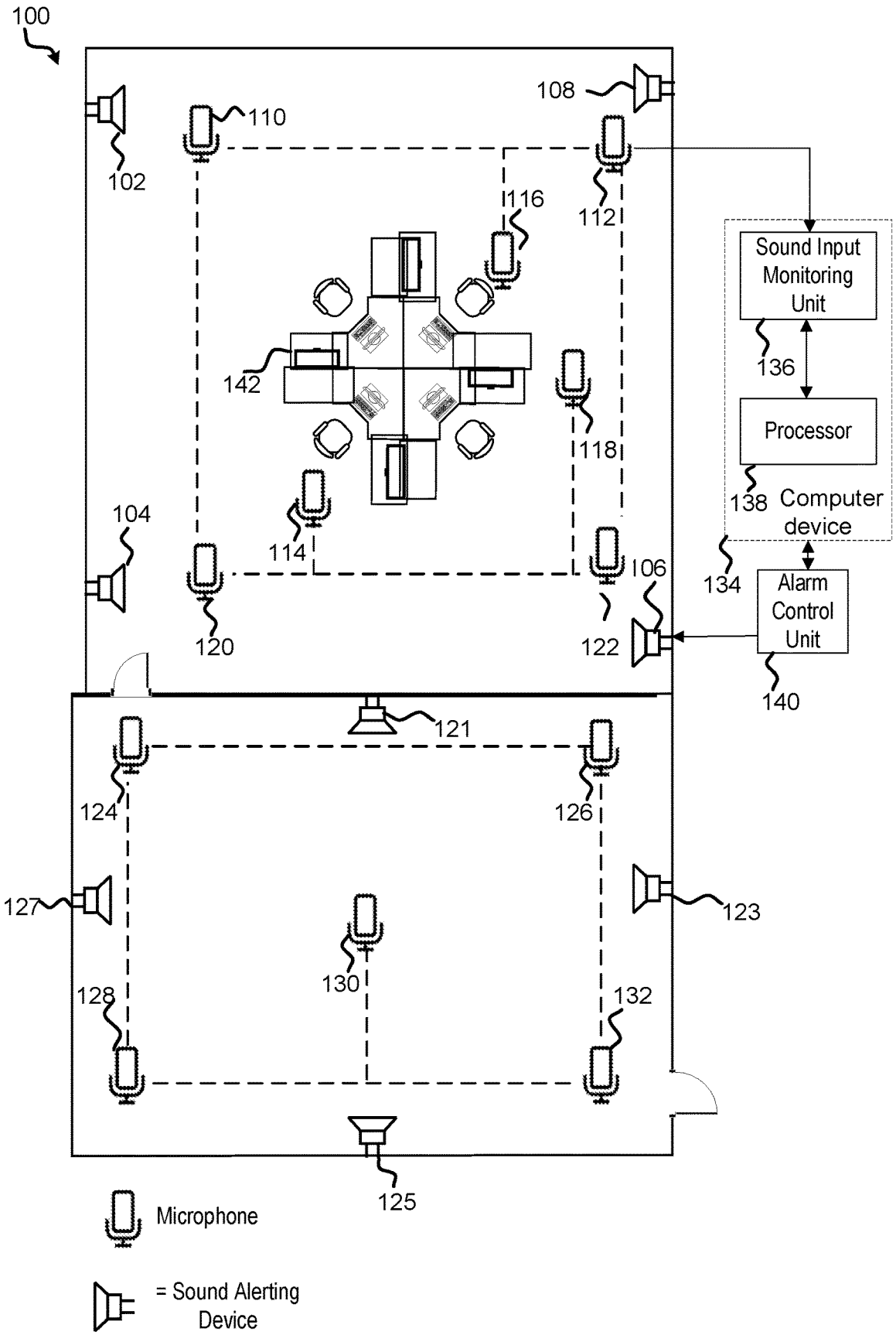
FIG. 1 is a block diagram of an alarm system with a computer device to configure the alarm system.

FIG. 1 is a block diagram of an alarm configuration system 100 with a computer device to configure the alarm system. The alarm configuration system 100 includes alerting devices 102, 104, 106 108, 121, 123, 125 and 127 which may be any kind of sound based alerting devices including speakers, sirens, PAS (Public Address System) devices, fire alarms, etc. The alerting devices 102, 104, 106 108, 121, 123, 125 and 127 may be communicatively coupled to an alarm control unit 140, such as via a wired or wireless communication link. The alarm control unit 140 may be communicatively coupled to a computer device 134 (and also to a processor 138 of the computer device 134), such as via a wired or wireless communication link or direct communication interface.

The alarm control unit 140 receives one or more control instructions from the computer device 134 and adjusts a sound output of the alerting devices 102, 104, 106 108, 121, 123, 125 and 127 to achieve a target alert sound level. For example, the alarm control unit 140 may send an instruction to each of the alerting devices 102, 104, 106 108, 121, 123, 125 and 127 to adjust their sound outputs (e.g., decibel (dB) values) based on the control instructions received from the computer device 134.

The computer device 134 may include the processor 138 and a sound input monitoring unit 136 communicatively coupled to the processor 138, such as via a wired or wireless communication link, a communication interface, and/or a bus. The sound input monitoring unit 136 may also be communicatively coupled to sound measuring devices 110, 116, 112, 122, 118, 114, 120, 124, 126, 132, 130 and 128, such as via a wired or wireless communication link. The sound input monitoring unit 136 may receive ambient noise levels at each of the measuring locations (i.e., the locations of the sound measuring devices 110, 116, 112, 122, 118, 114, 120, 124, 126, 132, 130 and 128). The sound measuring devices 110, 116, 112, 122, 118, 114, 120, 124, 126, 132, 130 and 128 may be communicatively coupled to each other via a wired or wireless communication link (such as, but not limited to, a mesh network). The interconnection of sound measuring devices, such as in the mesh network configuration, may allow the sound input monitoring unit 136 to receive data from each of the sound measuring devices 110, 116, 112, 122, 118, 114, 120, 124, 126, 132, 130 and 128 by utilizing a reduced amount of network resources. For example, the sound measuring devices 110, 116, 112, 122, 118, 114, 120, 124, 126, 132, 130 and 128 may relay the ambient noise level data or the sound output data (i.e., the sound output from each of the alerting devices 102, 104, 106, 108, 121, 123, 125 and 127) to the sound input monitoring unit 136 via their interconnection over the mesh network. The relay of ambient noise level data or the sound output data over the interconnected mesh network allows power savings and savings of network resources. For instance, in some implementations, a sound measuring device (e.g., the sound measuring device 130) may be located at a significant distance from the sound input monitoring unit 136 (and/or the alarm control unit 140), and if the sound measuring device 130 has to transmit the ambient noise level data or the sound output data directly to the sound input monitoring unit 136 (or receive configuration changes from the alarm control unit 140), such a transmission may incur significant network resources.

The alarm configuration system 100 may include sound measuring device in the same area or zone as the alerting devices, and/or in different areas/zones as a sound alerting device may provide a sufficient sound level to satisfy requirements for the different area/zone. For instance, in one example, the sound measuring devices 110, 116, 112, 122, 118, 114, 120 may comprise a first set of measuring devices located in a same location as a first set of alerting devices 102, 108, 106 104. The sound measuring devices 124, 126, 132, 130 and 128 may comprise a second set of measuring devices and the alerting devices 121, 123, 125 and 127 may comprise a second set of alerting devices that may be located at a different or a distant location from the first set of measuring devices.

In one implementation, the second set of measuring devices may be used to determine whether an output of the first set of alerting devices 102, 108, 106 and 104 can be detected at the respective measuring locations of the second set of measuring devices. For example, the first set of sound measuring devices 110, 116, 112, 122, 118, 114, 120 may be located in proximity of an open office environment 142, while the second set of sound measuring devices 124, 126, 132, 130 and 128 and the second set of alerting devices 121, 123, 125 and 127 may be located in a meeting room, a staircase, etc. In one example, the first set of alerting devices 102, 104, 106 and 108 may generate a sound output that can be detected at the second set of sound measuring devices 124, 126, 132, 130 and 128. The sound input monitoring unit 136 may receive sound measurements from the second set of sound measuring devices 124, 126, 132, 130 and 128. The sound input monitoring unit 136 may update the alarm control unit 140 (via the processor 138) to adjust the sound output of the first set of alerting devices 102, 104, 106 and 108 such that the sound output as detected by the second set of sound measuring devices 124, 126, 132, 130 and 128 is at a target alert sound level. The alarm control unit 140 may also adjust the sound output of the second set of second set of alerting devices 121, 123, 125 and 127. For example, the first set of alerting devices 102, 104, 106 and 108 may generate a strong enough output to be usable in total or partially by the second set of sound measuring devices 124, 126, 132, 130 and 128 and the alarm control unit 140 may reduce the sound output of the second set of alerting devices 121, 123, 125 and 127 or deactivate the second set of alerting devices 121, 123, 125 and 127.

In another implementation, the first set of alerting devices 102, 104, 106 and 108 may generate a sound output that is not to be detected at the second set of sound measuring devices 124, 126, 132, 130 and 128. For example, it may not be desirable to detect the same alert or instructions (e.g., evacuate, standby, etc.) at the second set of sound measuring devices 124, 126, 132, 130 as detected by the first set of sound measuring devices 110, 116, 112, 122, 118, 114, 120. The sound input monitoring unit 136 may receive sound measurements from the second set of sound measuring devices 124, 126, 132, 130 and 128. The sound input monitoring unit 136 may update the alarm control unit 140 (via the processor 138) to adjust the sound output of the first set of alerting devices 102, 104, 106 and 108 such that the no sound output is detected by the second set of sound measuring devices 124, 126, 132, 130 and 128. By a similar process, the alarm control unit 140 may also adjust the sound output of the second set of second set of alerting devices 121, 123, 125 and 127 such that no sound output of the second set of the alerting devices is detected at the first set of sound measuring devices 110, 116, 112, 122, 118, 114, 120.

In one implementation, a zone 1 may have the first set of alerting devices 102, 108, 106 and 104 and the first set of sound measuring devices 110, 116, 112, 122, 118, 114, 120 and a zone 2 may have the second set of alerting devices second set of alerting devices 121, 123, 125 and 127 and the second set of sound measuring devices 124, 126, 132, 130 and 128. If an alert at zone 1 is to evacuate and an alert at zone 2 is to await further instructions, the sound output of the first set of alerting devices 102, 108, 106 and 104 in the zone 1 must not be heard at the second set of sound measuring devices 124, 126, 132, 130 and 128 in zone 2. To achieve this, the alarm control unit 140 may adjust the output of the first set of alerting devices 102, 108, 106 and 104 based on cross-monitoring of the first set of alerting devices 102, 108, 106 and 104 in zone 1 by the second set of sound measuring devices 124, 126, 132, 130 and 128 in zone 2. The alarm control unit 140 may lower or eliminate the amount of sound overheard in the zone 2 by the second set of sound measuring devices 124, 126, 132, 130 and 128.

As described above, the sound input monitoring unit 136 may receive sound measurements from each of the first set of measuring devices and the second set of measuring devices in order to update the alarm control unit 140 (via the processor 138) to adjust the sound output of the alerting devices 102, 104, 106, 108, 121, 123, 125 and 127.

Figure 2:
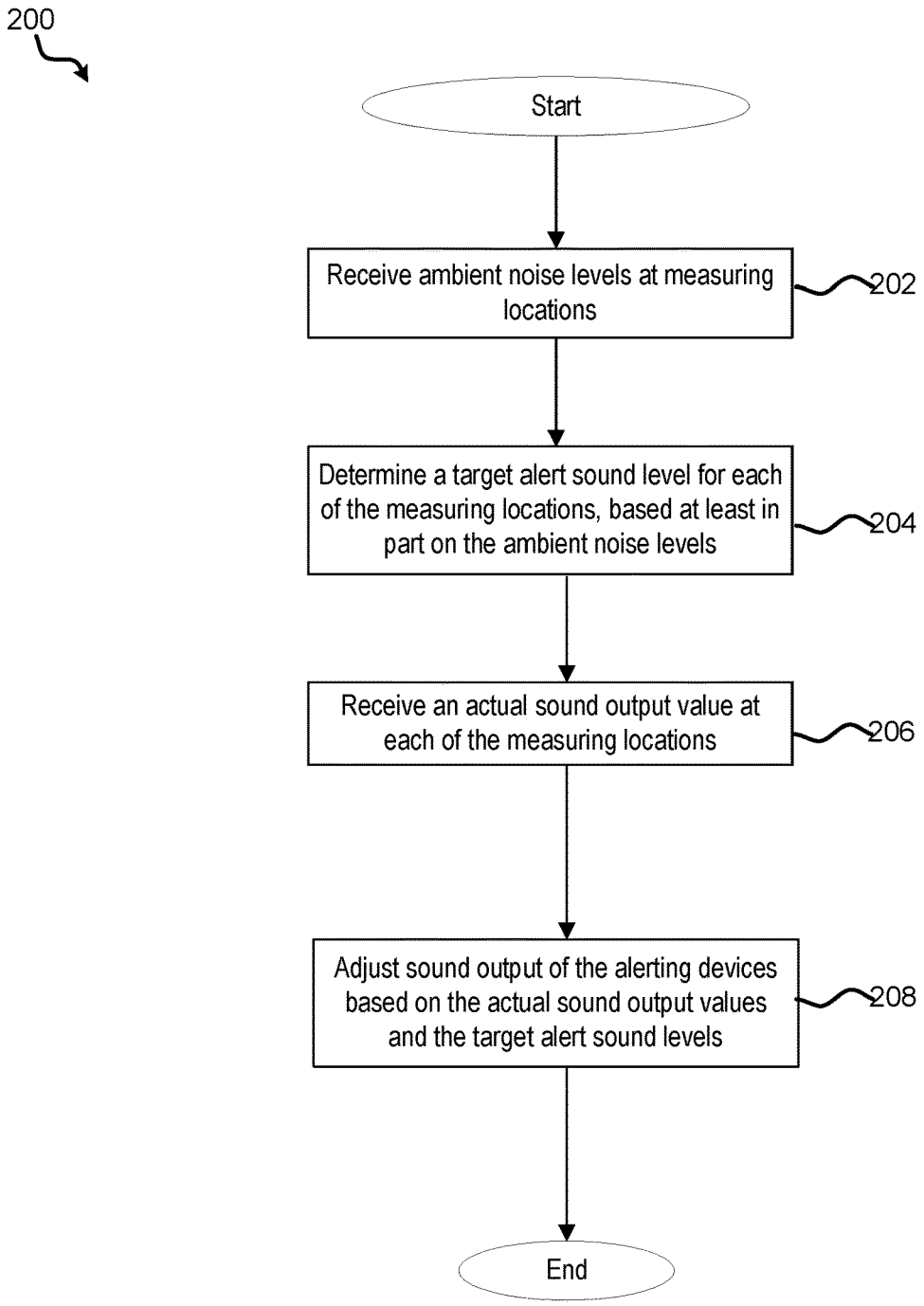
FIG. 2 is a flow diagram of an exemplary method for configuring the alarm system.

FIG. 2 is a flow diagram for an exemplary method 200 for configuring the alarm system 100. FIG. 2 includes the exemplary method 200 and includes various actions that may be performed by one or more components of the alarm configuration system 100 (FIG. 1).

At block 202, the method 200 includes receiving ambient noise levels at measuring locations. For example, the sound input monitoring unit 136 receives the ambient noise levels at the measuring locations of the sound measuring devices 110, 116, 112, 122, 118, 114, 120, 124, 126, 132, 130 and 128. In one implementation, the sound input monitoring unit 136 receives the ambient noise levels from one or more microphones installed at each of the locations of the sound measuring devices 110, 116, 112, 122, 118, 114, 120, 124, 126, 132, 130 and 128, and may communicate the received ambient noise levels to the processor 138 for determining the target alert sound levels at each of the measuring locations.

In another implementation, the sound input monitoring unit 136 may receive the ambient noise levels at locations of the respective sound measuring devices 110, 116, 112, 122, 118, 114, 120, 124, 126, 132, 130 and 128, and may filter out a peak ambient noise level measurement from each of the received noise levels to define a filtered plurality of noise level measurements. In one example, the sound input monitoring unit 136 can then determine a peak ambient noise level from the filtered plurality of noise level measurements. In another example, the sound input monitoring unit 136 can determine an average ambient noise level from the received ambient noise levels. The microphone monitoring unit 136 may communicate either the peak ambient noise level or the average ambient noise level to the processor 138 for determining the target alert sound levels at each of the measuring locations.

At block 204, the method 200 includes determining a target alert sound level for each of the measuring locations, based at least in part on the ambient noise levels. For example, the processor 138 determines the target alert sound level for the respective locations of each of the sound measuring devices 110, 116, 112, 122, 118, 114, 120, 124, 126, 132, 130 and 128. In one implementation, the processor 138 determines the target alert sound level based on certain standards. For example, the processor 138 may determine the target alert sound level based on reading values from a table (stored in the memory of the computer device 134) comprising a listing of standards and one or more ambient noise level thresholds corresponding to each of the listing of standards. In one example, a standard may specify that the target alert sound level is at least 15 dB above the ambient noise level. In another example, an end-user may specify an upper limit for the target alert sound level (for example 65 dBA in a hospital environment to limit stress on patients). In another example, a standard may specify an upper limit (for example 100 dBA) to limit exposure to dangerously high sound levels.

In another implementation, the processor 138 may determine the target alert sound level for the respective locations of each of the sound measuring devices 110, 116, 112, 122, 118, 114, 120, 124, 126, 132, 130 and 128 based on specifications of a standard and using the peak ambient noise level (determined at block 202) to determine the target alert sound levels. In yet another implementation, the processor 138 may determine the target alert sound level for the respective locations of each of the sound measuring devices 110, 116, 112, 122, 118, 114, 120, 124, 126, 132, 130 and 128 based on specifications of a standard and using the average ambient noise level (determined at block 202) to determine the target alert sound levels.

At block 206, the method 200 includes receiving actual sound output value at each of the measuring locations. For example, the sound input monitoring unit 136 may receive the actual sound output values from the alerting devices 102, 104, 106, 108, 121, 123, 125 and 127 at each of the measuring locations of the sound measuring devices 110, 116, 112, 122, 118, 114, 120, 124, 126, 132, 130 and 128. In one implementation, all the alerting devices 102, 104, 106, 108, 121, 123, 125 and 127 are enabled and sound output values at each of the measuring locations of the sound measuring devices 110, 116, 112, 122, 118, 114, 120, 124, 126, 132, 130 and 128 is received. The actual sound output values received from the sound measuring devices 110, 116, 112, 122, 118, 114, 120, 124, 126, 132, 130 and 128 may be sent to the processor 138. For example, the processor 138 may receive the actual sound output values from the sound measuring devices 110, 116, 112, 122, 118, 114, 120, 124, 126, 132, 130 and 128 via a wired communication link or a wireless communication link (e.g., a mesh network), etc.

In another implementation, some of the alerting devices 102, 104, 106, 108, 121, 123, 125 and 127 may be enabled and actual sound output values from each of the measuring locations of the sound measuring devices 110, 116, 112, 122, 118, 114, 120, 124, 126, 132, 130 and 128 may be received. The actual sound output values received from the sound measuring devices 110, 116, 112, 122, 118, 114, 120, 124, 126, 132, 130 and 128 may be sent to the processor 138 for selectively adjusting sound output values (at block 208) of the respective alerting devices 102, 104, 106, 108, 121, 123, 125 and 127 that were enabled for measuring the actual sound output values. Based on the actual sound output values so received, the processor 138 may determine that one or more of the alerting devices 102, 104, 106, 108, 121, 123, 125 and 127 may not be necessary to be activated for achieving the target alert sound levels at all the locations of the sound measuring devices 110, 116, 112, 122, 118, 114, 120, 124, 126, 132, 130 and 128.

At block 208, the method 200 includes adjusting sound output of the alerting devices based on the actual sound output values and the target alert sound levels. For example, the processor 138 may instruct the alarm control unit 140 to adjust the sound output of the alerting devices 102, 104, 106, 108, 121, 123, 125 and 127. In one implementation, the processor 138 may instruct the alarm control unit 140 to adjust the sound output of each of the alerting devices 102, 104, 106, 108, 121, 123, 125 and 127 by an adjustment value determined using the difference between the actual sound output values and the target alert sound levels. For example, the processor 138 may instruct the alarm control unit 140 to reduce the sound output values of one or more of the alerting devices 102, 104, 106, 108, 121, 123, 125 and 127 which have their respective actual sound output value more than the target alert sound levels. The processor 138 may also instruct the alarm control unit 140 to increase the sound output values of one or more of the alerting devices 102, 104, 106, 108, 121, 123, 125 and 127 which have their actual sound output value less than the target alert sound levels.

In another implementation, the processor 138 may instruct the alarm control unit 140 to adjust the sound output of each of the alerting devices 102, 104, 106, 108, 121, 123, 125 and 127 by an adjustment value, such that the adjustment value is between a minimum sound threshold value and a maximum sound threshold value. The alarm control unit 140 may then adjust (i.e., increase or decrease) the sound output of one or more of the alerting devices 102, 104, 106, 108, 121, 123, 125 and 127 based on the instructions received from the processor 138.

Figure 3:
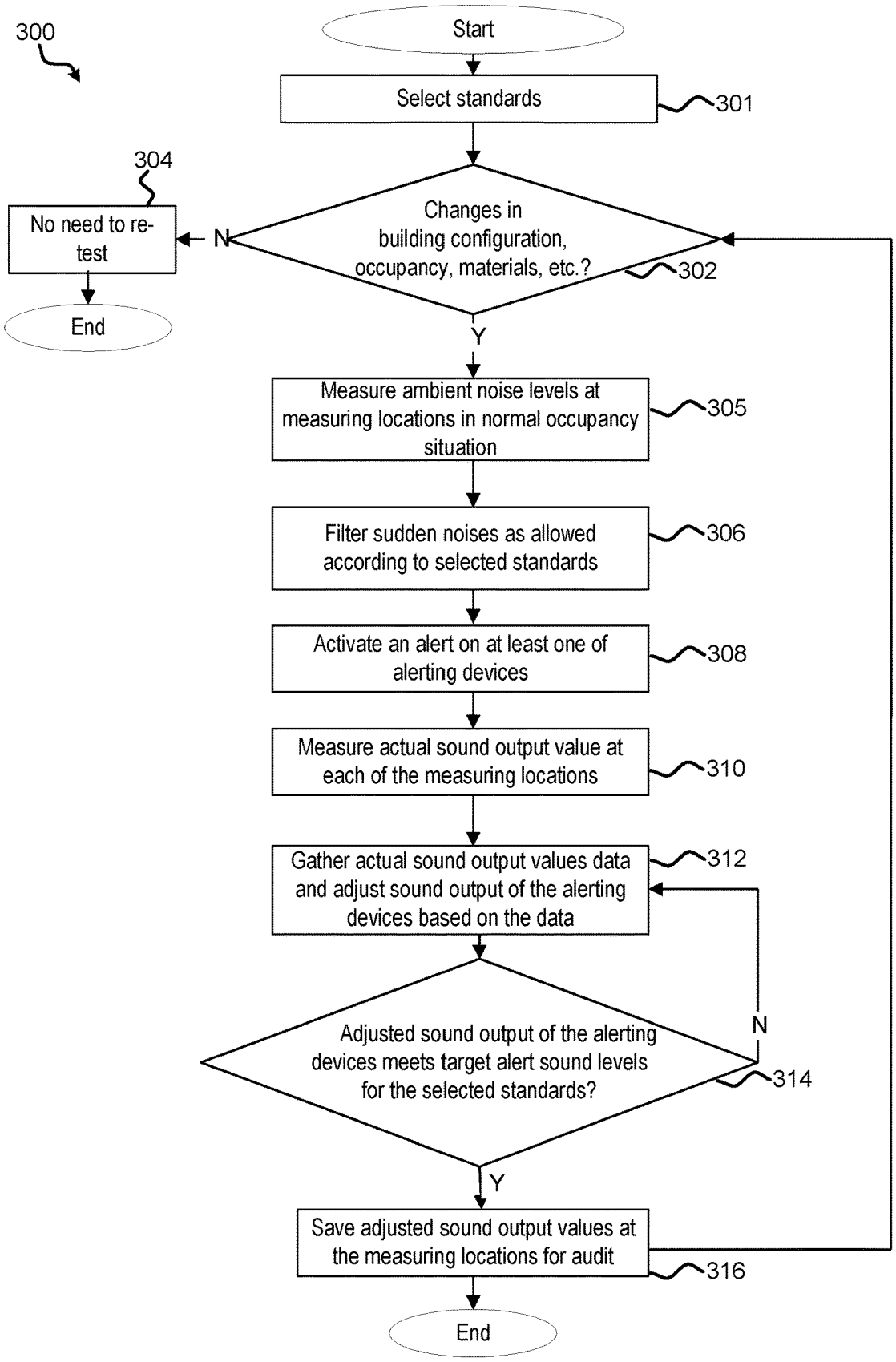
FIG. 3 is a flow diagram for another exemplary method for configuring the alarm system.

FIG. 3 is a flow diagram for an exemplary method 300 for configuring the alarm system 100. FIG. 3 includes the exemplary method 300 and includes various actions that may be performed by one or more components of the alarm configuration system 100 (FIG. 1).

At block 301, the method 300 includes selecting standards. For example, the processor 138 may select (or receive a user input selection of) one or a combination of standards that specify the target alert sound levels for the alerting devices 102, 104, 106, 108, 121, 123, 125 and 127. The standards may be based on jurisdiction (e.g., country-specific regulations, municipal regulations, etc.) or based on geography/type of environment (e.g., different standards for a school, a hospital, an office, etc.).

At block 302, the method 300 includes determining whether any changes in building configuration, occupancy, or materials have occurred. Upon determining that such changes have not occurred, the control flows to block 304. Upon determining that such changes have occurred, the control flows to block 305. For example, the processor 138 may receive one or more inputs for indicating updated building data and/or any changes in the building configuration, occupancy, or materials that may have occurred. The processor 138 may then compare the updated building data with one or more sets of building data stored in a memory of the computer device 134 to determine whether to retest one or more of the alerting devices 102, 104, 106, 108, 121, 123, 125 and 127. Such changes, may require a recalibration of the sound output values of the alerting devices 102, 104, 106, 108, 121, 123, 125 and 127 based on the changes and the selected standards.

In one implementation, the processor 138 may have a floorplan stored in a memory of the computer device 134 and could store information about which alerting devices may have an influence on which of the sound measuring devices. As such, in the event of any changes in the building configuration, occupancy, or materials, the processor 138 may prompt the user to retest only a selected number of alerting devices that the processor 138 may determine to be impacted. For example, if the alerting devices 102, 104, 106, 108, 121, 123, 125 and 127 can be set up to 87 dBA, it could prompt the user to retest any locations that are within a specified distance from the change (for example, a partition wall that was added) based on the consideration that 87 dBA could have an impact over the specified distance.

At block 304, the method 300 includes determining that there is no need to re-test and the method 300 terminates. For example, the processor 138 may determine that there is no need to re-test as no changes have occurred, and the method 300 may conclude.

At block 305, in response to determining a change has occurred in block 302, the method 300 includes measuring average ambient noise levels at measuring locations in normal occupancy situation. For example, the processor 138 may instruct the sound measuring devices 110, 116, 112, 122, 118, 114, 120, 124, 126, 132, 130 and 128 to measure the ambient noise levels at the respective measuring locations in an occupancy situation that confirms to the purpose of the building (e.g., measuring the ambient noise levels in a school when children are present). The sound input monitoring unit 136 may receive the ambient noise level measurements from the respective locations of the sound measuring devices 110, 116, 112, 122, 118, 114, 120, 124, 126, 132, 130 and 128, as described in detail above.

At block 306, the method 300 includes filtering sudden noises as allowed according to selected standards. For example, the processor 138 may filter out certain spike noise levels, lasting for a duration less than a pre-determined duration, from the measurements received from the sound measuring devices 110, 116, 112, 122, 118, 114, 120, 124, 126, 132, 130 and 128 based on the standards selected at block 301. In one implementation, the processor 138 may determine to filter out sudden (spike) noises that have a duration less than 60 seconds and determine a peak ambient noise level after filtering out the sudden (spike) noises. In one example, the processor 138 filters out a sound of a school bell (e.g., 80 dBA) having a duration of less than 60 seconds when determining the peak ambient sound level. However, a sound of a train passing nearby (e.g., 68 dBA) for a duration of 100 seconds may be included when determining the peak ambient noise level. In another example, the processor 138 may determine an average ambient noise level over a comparatively longer period of time from the measurements received from the sound measuring devices 110, 116, 112, 122, 118, 114, 120, 124, 126, 132, 130 and 128 based on the standards selected at block 301. For example, the average ambient noise level may be taken over a comparatively longer period (e.g., 24 hours, during business hours for an office, or school hours for a school, etc.).

At block 308, the method 300 includes activating an alert on at least one of the alerting devices. For example, the processor 138 may instruct the alarm control unit 140 to activate the alert at one or more of the alerting devices 102, 104, 106, 108, 121, 123, 125 and 127. In one implementation, the processor 138 may send a control signal to the alarm control unit 140 to activate the alert at one or more of the alerting devices 102, 104, 106, 108, 121, 123, 125 and 127. The alarm control unit 140 may update the processor 138 once the alert on the specified devices has been activated.

At block 310, the method 300 includes measuring actual sound output value of each of the measuring locations. For example, the processor 138 may instruct the sound input monitoring unit 136 to measure the actual sound output value (of the alerting devices 102, 104, 106, 108, 121, 123, 125 and 127 activated at block 308) at each of the measuring locations of the sound measuring devices 110, 116, 112, 122, 118, 114, 120, 124, 126, 132, 130 and 128. The sound input monitoring unit 136 may receive the actual sound output values from the sound measuring devices 110, 116, 112, 122, 118, 114, 120, 124, 126, 132, 130 and 128 via a wired or a wireless communication link (e.g., a mesh network), etc. The sound input monitoring unit 136 may send the actual sound output values to the processor 138.

At block 312, the method 300 includes gathering actual sound output values data and adjusting the sound output of the alerting devices based on the data. For example, the processor 138 may gather the actual sound output values from the sound input monitoring unit 136. In one implementation, the processor 138 may receive the actual sound output values from the sound input monitoring unit 136 via a bus interconnection. The processor 138 may use the actual sound output values to adjust the sound output values of the activated (at block 308) alerting devices 102, 104, 106, 108, 121, 123, 125 and 127 based on the selected standards (at block 302) and the ambient noise levels (at blocks 305 and 306) using one or more of the techniques described at block 208 in FIG. 2.

At block 314, the method 300 includes determining whether the adjusted sound output of the alerting devices meets target alert sound levels for the selected standards. Upon determining that the adjusted sound output of the alerting devices meets target alert sound levels for the selected standards, control flows to block 316. Upon determining that the adjusted sound output of the alerting devices do not meet the target alert sound levels for the selected standards, the control loops back to block 312, and the adjusted actual sound output values are further adjusted in an attempt to meet the target. Such adjustments may be to increase or decrease the sound level, as discussed above.

At block 316, the method 300 includes saving adjusted sound output values at the measuring locations for audit. For example, the adjusted sound output values of the alerting devices 102, 104, 106, 108, 121, 123, 125 and 127 may be saved for audit in a memory of the computer device 134. The saved values may be reviewed by an operator to determine whether the saved values and the operations of the alerting devices 102, 104, 106, 108, 121, 123, 125 and 127 confirms to the desired standards for the alarm system 100. In one implementation, the saved values may be utilized to replace a defective alerting device, without having to perform retesting or recalibration of a new sound alerting device installed to replace the defective alerting device. For example, a defective device may be replaced with a similar type of device and may be reconfigured to the same output level. In another example, the defective device may be replaced with a replacement device that has a higher sound output level and the alarm control unit 138 may determine settings for configuring the replacement device based on a concordance table between the defective device (with corresponding saved values) and the replacement device specifications to reduce or eliminate extensive retests of the replacement device. When the alerting devices 102, 104, 106, 108, 121, 123, 125 and 127 are saved, the flow of the method 300 concludes.

Figure 4:
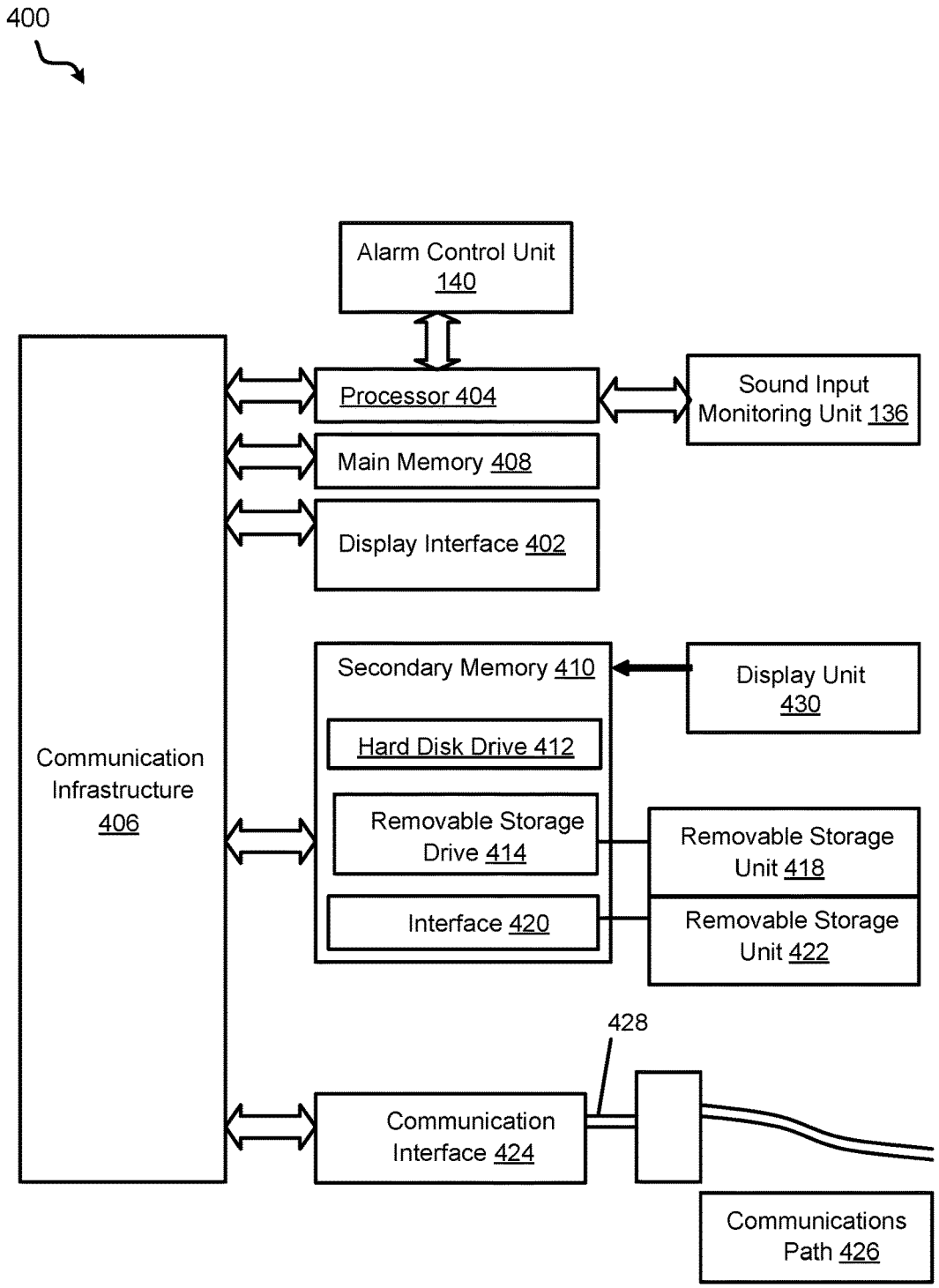
FIG. 4 is a system diagram of a computer device operable to configuring an alarm system in accordance with the present disclosure.

Referring to FIG. 4, an example of a computer device 400 operable for configuring an alarm system may include a set of components configured in accordance with the present disclosure. The computer device 400 embodies all functionalities of the computer device 134 (as described in FIGS. 1-3). The computer device 400 includes one or more processors, such as processor 404. The processor 404 is connected to a communication infrastructure 406 (e.g., a communications bus, cross-over bar, or network). Various software aspects are described in terms of this example computer system. After reading this description, it will become apparent to a person skilled in the relevant art(s) how to implement aspects of the disclosure using other computer systems and/or architectures such as a personal computing device (e.g., a tablet, a mobile phone, laptop, a PDA (Personal Digital Assistant, a dedicated self-designed electronic system, etc.).

Computer device 400 may include a display interface 402 that forwards graphics, text, and other data from the communication infrastructure 406 (or from a frame buffer not shown) for display on a display unit 430. Computer device 400 also includes a main memory 408, preferably random access memory (RAM), and may also include a secondary memory 410. The secondary memory 410 may include, for example, a hard disk drive 412, and/or a removable storage drive 414, representing a floppy disk drive, a magnetic tape drive, an optical disk drive, a universal serial bus (USB) flash drive, etc. The removable storage drive 414 reads from and/or writes to a removable storage unit 418 in a well-known manner. Removable storage unit 418 represents a floppy disk, magnetic tape, optical disk, USB flash drive etc., which is read by and written to removable storage drive 414. As will be appreciated, the removable storage unit 418 includes a computer usable storage medium having stored therein computer software and/or data.

The computer device 400 also includes, the sound input monitoring unit 136 interfaced to the processor 404 of the computer device 400. The processor 404 may be coupled with the alarm control unit 140. The alarm control unit 140 and the sound input monitoring unit 136 have similar functions as described in FIG. 1. The processor 404 embodies all functionalities of the processor 138 (FIG. 1). The processor 404 of the computer device 400 may be coupled to, the sound input monitoring unit 136 with the sound input monitoring unit 136 implemented as a standalone device. The processor 404 may perform one or more operations by processing the instructions stored in the respective units to perform the operations of the respective unites as described in FIGS. 1, 2 and 3.

Alternative aspects of the present disclosure may include secondary memory 410 and may include other similar devices for allowing computer programs or other instructions to be loaded into computer device 400. Such devices may include, for example, a removable storage unit 422 and an interface 420. Examples of such may include a program cartridge and cartridge interface (such as that found in video game devices), a removable memory chip (such as an erasable programmable read only memory (EPROM), or programmable read only memory (PROM)) and associated socket, and other removable storage units 422 and interfaces 420, which allow software and data to be transferred from the removable storage unit 422 to computer device 400.

Computer device 400 may also include a communications interface 424. Communications interface 424 allows software and data to be transferred between computer device 400 and external devices. Examples of communications interface 424 may include a modem, a network interface (such as an Ethernet card), a communications port, a Personal Computer Memory Card International Association (PCMCIA) slot and card, etc. Software and data transferred via communications interface 424 are in the form of signals 428, which may be electronic, electromagnetic, optical or other signals capable of being received by communications interface 424. These signals 428 are provided to communications interface 424 via a communications path (e.g., channel) 426. This path 426 carries signals 428 and may be implemented using wire or cable, fiber optics, a telephone line, a cellular link, a radio frequency (RF) link and/or other communications channels. In this document, the terms "computer program medium" and "computer usable medium" are used to refer generally to media such as a removable storage drive 418, a hard disk installed in hard disk drive 412, and signals 428. These computer program products provide software to the computer device 400. Aspects of the present disclosure are directed to such computer program products.

Computer programs (also referred to as computer control logic) are stored in main memory 408 and/or secondary memory 410. Computer programs may also be received via communications interface 424. Such computer programs, when executed, enable the computer device 400 to perform the features in accordance with aspects of the present disclosure, as discussed herein. In particular, the computer programs, when executed, enable the processor 404 to perform the features in accordance with aspects of the present disclosure. Accordingly, such computer programs represent controllers of the computer device 400.

In an aspect of the present disclosure where the disclosure is implemented using software, the software may be stored in a computer program product and loaded into computer device 400 using removable storage drive 414, hard drive 412, or communications interface 420. The control logic (software), when executed by the processor 404, causes the processor 404 to perform the functions described herein. In another aspect of the present disclosure, the system is implemented primarily in hardware using, for example, hardware components, such as application specific integrated circuits (ASICs). Implementation of the hardware state machine so as to perform the functions described herein will be apparent to persons skilled in the relevant art(s).

As used herein, an element or step recited in the singular and proceeded with the word "a" or "an" should be understood as not excluding plural elements or steps, unless such exclusion is explicitly recited. Furthermore, references to "one embodiment" are not intended to be interpreted as excluding the existence of additional embodiments that also incorporate the recited features.

The various embodiments or components described above, for example, the alarm control unit, the sound input monitoring unit, the computing device, and the components or processors therein, may be implemented as part of one or more computer systems. Such a computer system may include a computer, an input device, a display unit and an interface, for example, for accessing the Internet. The computer may include a microprocessor. The microprocessor may be connected to a communication bus. The computer may also include memories. The memories may include Random Access Memory (RAM) and Read Only Memory (ROM). The computer system further may include a storage device, which may be a hard disk drive or a removable storage drive such as a floppy disk drive, optical disk drive, and the like. The storage device may also be other similar means for loading computer programs or other instructions into the computer system. As used herein, the term "software" includes any computer program stored in memory for execution by a computer, such memory including RAM memory, ROM memory, EPROM memory, EEPROM memory, and non-volatile RAM (NVRAM) memory. The above memory types are exemplary only, and are thus not limiting as to the types of memory usable for storage of a computer program.

While certain embodiments of the disclosure have been described herein, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision other modifications within the scope and spirit of the claims appended hereto.

What is claimed is:

1. A method of configuring an alarm system, comprising:

receiving, by a processor of a sound measuring device, an ambient noise level at a plurality of measuring locations in a building;

determining, by the processor and for each of the plurality of the measuring locations, a target alert sound level of an alert generated by at least one of a plurality of alerting devices based at least in part on the ambient noise level at a respective measuring location, wherein the plurality of alerting devices comprise a first set of alerting devices located in a same location as a first set of measuring devices and at least one of the first set of alerting devices located in a different location from a second set of measuring devices and a second set of alerting devices, the second set of measuring devices detecting sound from the first set of alerting devices at the target sound level with the second set of alerting devices being turned off;

receiving, by the processor, an actual sound output value of the alert received at each of the second set of measuring devices from one or more of the plurality of alerting devices; and adjusting, by the processor, a sound output of each of the plurality of alerting devices by a respective adjustment value based on the actual sound output values and the target alert sound level, including reducing the sound output level of the second set of alerting devices when activated in conjunction with the first set of alerting devices.

2. The method of claim 1, further comprising:

activating, by the processor, the alert at the one or more of the plurality of alerting devices to generate the respective actual sound output values of the alert.

3. The method of claim 1, further comprising:

determining whether the respective actual sound output values meet the respective target alert sound levels; and wherein adjusting the sound output of each of the plurality of alerting devices by the respective adjustment value is based on a difference between the actual sound output values and the target alert sound levels.

4. The method of claim 1, wherein adjusting the sound output of each of the plurality of alerting devices by the respective adjustment value further comprises determining the respective adjustment value to meet a sound level over an ambient noise level threshold.

5. The method of claim 1, wherein adjusting the sound output of each of the plurality of alerting devices by the respective adjustment value further comprises determining the respective adjustment value to be between a minimum sound threshold and a maximum sound threshold.

6. The method of claim 1, further comprising:

measuring, by the first set of measuring devices and the second set of measuring devices, the ambient noise level at the plurality of measuring locations and the actual sound output values at the measuring locations.

7. The method of claim 6, wherein measuring, by the first set of measuring devices and the second set of measuring devices, comprises measuring by a microphone.

8. The method of claim 1, wherein receiving the ambient noise level at the plurality of measuring locations in the building comprises receiving via a wired communication link or via a wireless communication link.

9. The method of claim 1, wherein one or more of the plurality of alerting devices comprise a fire alarm.

10. The method of claim 1, further comprising:

at a second time different from a first time corresponding to the second set of measuring devices detecting sound from the first set of alerting devices at the target sound level with the second set of alerting devices being turned off:

receiving, by the processor, a second actual sound output value of the alert received at each of the second set of measuring devices from one or more of the plurality of alerting devices; and adjusting, by the processor, the sound output of each of the first set of alerting devices and the second set of alerting devices by a respective second adjustment value based on the second actual sound output values and the target alert sound level, such that the second set of measuring devices detect sound from the second set of alerting devices and detect no sound from the first set of the alerting devices.

11. The method of claim 1, wherein receiving the ambient noise level further comprises receiving a plurality of ambient noise level measurements, and further comprising:

filtering out a spike noise from the plurality of noise level measurements to define a filtered plurality of noise level measurements;

determining a peak ambient noise level from the filtered plurality of noise level measurements;

determining an average ambient noise level from the filtered plurality of noise level measurements; and wherein adjusting the sound output of each of the plurality of alerting devices is further based on at least one of the peak ambient noise level and the average ambient noise level.

12. The method of claim 1, further comprising:

at a second time different from a first time corresponding to the second set of measuring devices detecting sound from the first set of alerting devices at the target sound level:

receiving, by the processor, a second actual sound output value of the alert received at each of the second set of measuring devices from one or more of the plurality of alerting devices; and adjusting, by the processor, the sound output of each of the first set of alerting devices and the second set of alerting devices by a respective second adjustment value based on the second actual sound output values and the target alert sound level, such that the second set of measuring devices detect sound from the first set of alerting devices and the second set of alerting devices.

13. The method of claim 1, further comprising:

determining the target alert sound level based on reading values from a table comprising a listing of standards and one or more ambient noise level thresholds corresponding to each of the listing of standards.

14. A computer device for configuring an alarm system, comprising:

a memory;

a processor in communication with the memory;

a communication unit in communication with at least one of the processor or the memory;

at least one sound measuring device in communication with the communication unit;

wherein the processor is configured to:

receive, from a sound measuring device, an ambient noise level at a plurality of measuring locations in a building;

determine for each of the plurality of the measuring locations, a target alert sound level of an alert generated by at least one of a plurality of alerting devices based at least in part on the ambient noise level at a respective measuring location, wherein the plurality of alerting devices comprise a first set of alerting devices located in a same location as a first set of measuring devices and at least one of the first set of alerting devices located in a different location from a second set of measuring devices and a second set of alerting devices, the second set of measuring devices detecting sound from the first set of alerting devices at the target sound level with the second set of alerting devices being turned off;

receive an actual sound output value of the alert received at each of the second set of measuring devices from one or more of the plurality of alerting devices; and adjust a sound output of each of the plurality of alerting devices by a respective adjustment value based on the actual sound output values and the target alert sound level, including the processor configured to reduce the sound output level of the second set of alerting devices when activated in conjunction with the first set of alerting devices.

15. The computer device of claim 14, wherein the processor is further configured to:

activate the alert at the one or more of the plurality of alerting devices to generate the respective actual sound output values of the alert.

16. The computer device of claim 14, wherein the processor is further configured to:

determine whether the respective actual sound output values meet the respective target alert sound levels; and wherein the processor configured to adjust the sound output of each of the plurality of alerting devices by the respective adjustment value comprises the processor configured to adjust the sound output based on a difference between the actual sound output values and the target alert sound levels.

17. The computer device of claim 14, wherein the processor configured to:

adjust the sound output of each of the plurality of alerting devices by the respective adjustment value further comprises the processor configured to determine the respective adjustment value to be between a minimum sound threshold and a maximum sound threshold.

18. The computer device of claim 14, wherein the sound measuring device is further configured to:

measure, by the first set of measuring devices and the second set of measuring devices, the ambient noise level at the plurality of measuring locations and the actual sound output values at the measuring locations.

19. The computer device of claim 14, wherein the processor configured to:

receive the ambient noise level at the plurality of measuring locations in the building comprises the processor configured to receive the ambient noise level via a wired communication link or via a wireless communication link.

20. The computer device of claim 14, wherein the processor configured to receive the ambient noise level comprises the processor configured to receive a plurality of ambient noise level measurements, and further comprising the processor configured to:

filter out a spike noise from the plurality of noise level measurements to define a filtered plurality of noise level measurements;

determine a peak ambient noise level from the filtered plurality of noise level measurements;

determine an average ambient noise level from the filtered plurality of noise level measurements; and wherein the processor configured to adjust the sound output of each of the plurality of alerting devices further comprises the processor configured to adjust the sound output of the alerting devices based on at least one of the peak ambient noise level and the average ambient noise level.

21. The computer device of claim 14, wherein the processor is further configured to:

at a second time different from a first time corresponding to the second set of measuring devices detect sound from the first set of alerting devices at the target sound level with the second set of alerting devices being turned off:

receive a second actual sound output value of the alert received at each of the second set of measuring devices from one or more of the plurality of alerting devices; and adjust the sound output of each of the first set of alerting devices and the second set of alerting devices by a respective second adjustment value based on the second actual sound output values and the target alert sound level, such that the second set of measuring devices detect sound from the first set of alerting devices and the second set of alerting devices.

22. The computer device of claim 14, wherein the processor is further configured to:

determine the target alert sound level based on reading from a table stored in the memory of the computer device, wherein the table comprises a listing of standards and one or more ambient noise level thresholds corresponding to each of the listing of standards.

23. A non-transitory computer readable medium storing computer-executable instructions for configuring an alarm system that, when executed by a processor, cause the processor to:

receive, from a sound measuring device, an ambient noise level at a plurality of measuring locations in a building;

determine for each of the plurality of the measuring locations, a target alert sound level of an alert generated by at least one of a plurality of alerting devices based at least in part on the ambient noise level at a respective measuring location, wherein the plurality of alerting devices comprise a first set of alerting devices located in a same location as a first set of measuring devices and at least one of the first set of alerting devices located in a different location from a second set of measuring devices and a second set of alerting devices, the second set of measuring devices detecting sound from the first set of alerting devices at the target sound level with the second set of alerting devices being turned off;

receive an actual sound output value of the alert received at each of the second set of measuring devices from one or more of the plurality of alerting devices; and adjust a sound output of each of the plurality of alerting devices by a respective adjustment value based on the actual sound output values and the target alert sound level, including causing the processor to reduce the sound output level of the second set of alerting devices when activated in conjunction with the first set of alerting devices.

* * * * *